US006726014B2

(12) United States Patent
Laurent

(10) Patent No.: US 6,726,014 B2
(45) Date of Patent: Apr. 27, 2004

(54) BUNDLE OF PRODUCTS CONSISTING OF ABSORBENT PAPER

(75) Inventor: Pierre Laurent, Colmar (FR)

(73) Assignee: Georgia-Pacific France, Kunheim (FR)

( * ) Notice: Subject to any disclaimer, the term of this patent is extended or adjusted under 35 U.S.C. 154(b) by 0 days.

(21) Appl. No.: 09/851,948

(22) Filed: May 10, 2001

(65) Prior Publication Data

US 2001/0040114 A1 Nov. 15, 2001

(30) Foreign Application Priority Data

May 11, 2000 (EP) ..... 00401295

(51) Int. Cl.[7] ..... B65D 73/00
(52) U.S. Cl. ..... 206/494; 206/812
(58) Field of Search ..... 206/494, 264, 206/233, 812, 581, 38, 37; 353/200, 203, 207, 66, 47; 221/47, 48, 63

(56) References Cited

U.S. PATENT DOCUMENTS

| | | | | | |
|---|---|---|---|---|---|
| 426,341 | A | | 4/1890 | Field et al. | |
| 3,161,336 | A | | 12/1964 | Loescher | |
| 3,186,628 | A | * | 6/1965 | Rohde | 206/364 |
| 3,349,993 | A | * | 10/1967 | Ells et al. | 383/203 |
| 4,290,526 | A | * | 9/1981 | Haiss | 206/525 |
| 4,460,088 | A | * | 7/1984 | Rugenstein et al. | 206/264 |
| 4,913,293 | A | * | 4/1990 | Sanders | 383/207 |
| 5,018,625 | A | * | 5/1991 | Focke et al. | 206/494 |
| 5,036,978 | A | * | 8/1991 | Frank et al. | 206/494 |
| 5,054,619 | A | * | 10/1991 | Muckenfuhs | 206/494 |
| 5,121,879 | A | * | 6/1992 | Focke et al. | 206/264 |
| 5,358,171 | A | * | 10/1994 | Focke | 206/264 |
| 5,380,094 | A | * | 1/1995 | Schmidt et al. | 206/494 |
| 5,516,000 | A | | 5/1996 | Freiburger et al. | |
| 5,524,759 | A | * | 6/1996 | Herzberg et al. | 206/233 |
| 5,564,562 | A | * | 10/1996 | Focke et al. | 206/233 |

FOREIGN PATENT DOCUMENTS

| | | |
|---|---|---|
| CA | 2037293 | 9/1991 |
| EP | 0030601 | 6/1981 |
| EP | 0446628 A1 | 9/1991 |
| EP | 0858958 A2 | 8/1998 |

* cited by examiner

*Primary Examiner*—Shian Luong

(57) ABSTRACT

The invention relates to a bundle (16) of stacked products (18) consisting of absorbent paper, of the type which comprises a sheet of flexible material, such as a plastic wrapping sheet (20), and of the type which comprises opening means making it possible to release a zone (86) for gripping at least one paper product (18) in order to extract it individually from the wrapping (20), and of the type of which the opening means comprise a flap (36) which is movable between an opening position and a closing position, covering the gripping zone (86), and which is a part of the wrapping sheet (20) delimited by a precut (72) or a cut of the wrapping sheet (20), characterized in that the precut (72) or cut is arranged in a corner (74) of the bundle (16) and comprises at least two portions which are connected to one another and which each extend over a separate face (22, 28) of the bundle (16).

12 Claims, 3 Drawing Sheets

BUNDLE OF PRODUCTS CONSISTING OF ABSORBENT PAPER

The invention relates to a bundle of products consisting of absorbent paper.

The invention relates more particularly to a bundle of stacked products consisting of absorbent paper.

Paper products, preferably rectangular, are produced from a sheet which is folded and cut in order to produce, for example, table napkins or handkerchiefs made of paper. The paper products are subsequently juxtaposed or stacked and then wrapped in a sheet of flexible material which may be a film of transparent plastic.

The bundle or case of products consisting of absorbent paper advantageously has a right-angled parallelepipedic shape with a large rectangular face, the width of which is smaller than the height.

In general, an aperture is made in a large face of the wrapping, the said aperture being substantially parallel to the plane of the paper products, so as to release a zone for gripping at least one paper product in order to extract it individually from the bundle.

The aperture may consist of a flap which is movable about an axis and, in the opening position, makes it possible to release the gripping zone.

Retaining means, such as an adhesive tape, which are fastened to the movable flap, are necessary in order to keep the latter in the closed position.

Such bundles have a number of disadvantages.

When the bundle, in particular a bundle of handkerchiefs, undergoes deformations, such as torsion substantially about an axis corresponding to its larger longitudinal direction, the retaining means are not always sufficient to ensure leak-tight closure of the gripping zone of the bundle. It often happens that the free edges of the movable flap are no longer in contact with the free edges of the aperture, dust then being liable to penetrate into the bundle and soil paper products.

The advantages afforded per se by disposable paper handkerchiefs or napkins, to be precise the fact that they are always clean and are more hygienic than textile products because they are used only once, are then greatly reduced.

Moreover, when the movable flap is in an opening position, the retaining means, which usually comprise an adhesive tape, may stick, for example, to one of the paper products or to the user's fingers and thus make it difficult to extract the products.

In order to overcome these disadvantages, the invention proposes a bundle of stacked products consisting of absorbent paper, of the type which comprises a sheet of flexible material, such as a plastic wrapping sheet, which is of parallelepipedic general shape defined by a height, a width and a thickness, and of the type which comprises opening means making it possible to release a zone for gripping at least one paper product in order to extract it individually from the wrapping, and of the type of which the opening means comprise a flap which is movable between an opening position, making it possible to release the zone for gripping at least one folded paper product, and a closing position, covering the gripping zone, and which is a part of the wrapping sheet delimited by a precut or a cut of the wrapping sheet, characterized in that the precut or cut is arranged in a corner of the bundle and comprises at least two portions which are connected to one another and which each extend over a separate face of the bundle.

According to other characteristics of the invention:

the movable flap is a part of the wrapping sheet delimited by a precut or a cut of the wrapping sheet, the said precut or cut being arranged in a corner of the bundle and comprising three portions which each extend over a separate face of the bundle, in that a first portion extends over a first face between two concurrent edges, and in that the second and third portions extend over a second and a third face respectively, starting from each of the ends of the first portion;

the first portion is an arc of a circle, the center of which corresponds substantially to the point of concurrence of the three edges which delimit the corner of the bundle;

the first portion comprises at least one straight-line segment;

the precut or the cut is substantially symmetrical with respect to a plane passing through the edge common to the second and third faces and through the bisector of the angle formed by the other two edges;

the first portion is a straight-line segment perpendicular to a plane passing through the edge common to the second and third faces and through the bisector of the angle formed by the other two edges;

the first face is one of the front faces;

at least one of the paper products is a handkerchief;

at least one of the paper products is a napkin;

the first face is one of the faces adjacent to the front faces.

According to a preferred embodiment of the invention:

the height and width are equal, in such a way that the bundle comprises square fore and rear front faces;

each paper product is folded so as to form a square, of which the number of thicknesses of absorbent paper is a multiple of four;

each folded paper product comprises sixteen thicknesses of absorbent paper;

its height and its width are between 50 and 58 millimeters.

Other characteristics and advantages of the invention will be gathered from a reading of the following detailed description, to understand which reference will be made to the accompanying drawings in which.

In order to make it easier to understand the description and the claims, the terms "fore", "rear", "straight", "left", "top" and "bottom" will be used in a non-limiting way according to the figures.

Figure 1:
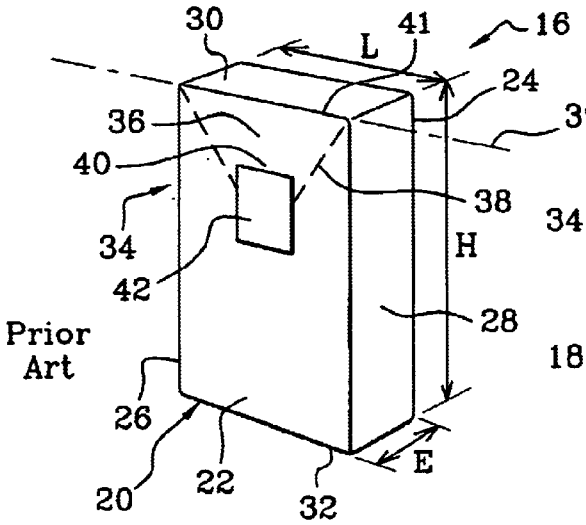
FIG. 1 is a view illustrating diagrammatically and in perspective an example of a bundle of paper handkerchiefs produced according to the prior art, a movable flap being in the closing position.
Figure 2:
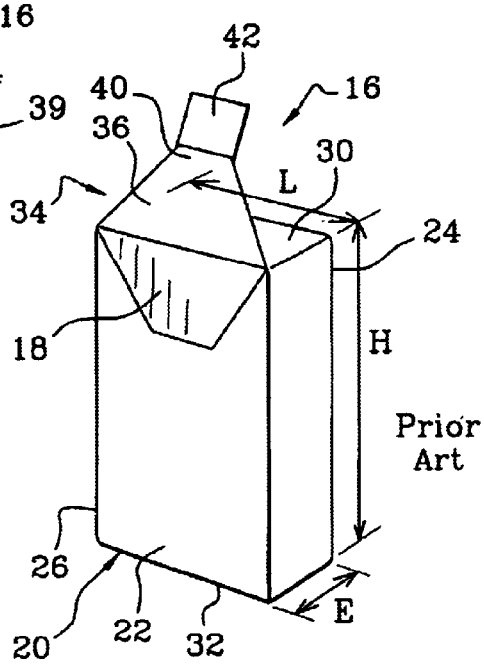
FIG. 2 is a view similar to that illustrated in FIG. 1, the movable flap being in the opening position.
Figure 3:
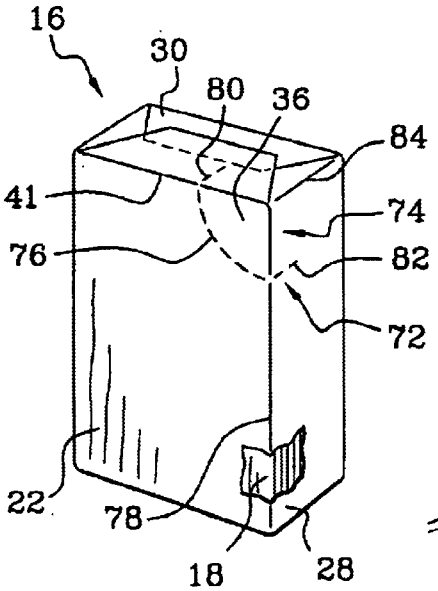
FIG. 3 is a diagrammatic perspective view of a bundle of handkerchiefs comprising opening means produced according to the invention.

FIGS. 1 and 2 each illustrate a bundle 16 of paper products, here paper handkerchiefs 18, according to the prior art.

The bundle 16 of paper handkerchiefs 18 is of a right-angled parallelepipedic general shape. It consists of a wrapping sheet 20 of flexible material, such as a plastic sheet, and it comprises two fore 22 and rear 24 front faces and four left 26, right 28, upper 30 and lower 32 lateral faces.

The wrapping sheet 20 is produced from a flexible material, usually a polyethylene film with a thickness of between 20 and 50 microns.

The bundle 16 of handkerchiefs 18 comprises, here on its fore front face 22, opening means 34 which consist of a flap 36 precut along dotted lines 38.

FIG. 1 illustrates the flap 36 in a closing position. FIG. 2, in turn, illustrates the flap 36 in its opening position.

According to FIGS. 1 and 2, the movable flap 36 is articulated about an axis 39 which, here, coincides with an edge 41 common to the fore front face 22 and to the upper face 30. Thus, the axis 39 is substantially parallel to the parallel planes containing the folded handkerchiefs 18.

At the time of first use, stress exerted on the lower part 40 of the flap 36 towards the front and/or towards the top of the bundle 16 makes it possible to separate the said flap from the fore front face 22 along the dotted lines 38. The flap 36 is then made movable between its closing position and an opening position, making it possible to release a zone for gripping at least one paper handkerchief 18.

So as to keep the flap 36 in the closing position after its first use, retaining means 42, such as an adhesive tape, are fastened to the lower part 40 of the movable flap 36. The retaining means 42 can be unstuck and restuck several times to the fore front face 22 of the wrapping 20.

The parallelepipedic bundle 16 of handkerchiefs 18 is defined by a height H, a width L and a thickness E.

This type of means 34 of opening a bundle 16 of handkerchiefs 18 has, in particular, the disadvantages described above.

For the purpose of overcoming these disadvantages, the invention proposes, according to FIGS. 3 to 9, that the movable flap 36 be a part of the wrapping sheet 20 which is delimited by a precut 72 of the wrapping sheet 20 and which is arranged in a corner 74, here the right upper fore corner, of the bundle 16 of handkerchiefs 18.

The precut 72 comprises three portions which each extend in a separate face of the wrapping 20.

A central or intermediate first portion 76 is made in a first face, here the fore front face 22. It consists, for example, of an arc of a circle, the center of which corresponds substantially to the vertex of the corner 74, that is to say to the point of concurrence of the three edges which delimit the corner 74 of the bundle 16, and which extends between two concurrent edges 41 and 78 which correspond to the two edges of the fore face 22. The dimensions of the arc of a circle are preferably close to those of the end of a user's thumb.

The second and third end portions 80 and 82 each extend over a second and a third face, here over the upper lateral face 30 and the right lateral face 28 respectively.

Each end portion 80, 82 is a straight-line segment parallel to the edge 84 which corresponds to the intersection of the faces 28 and 30, and it extends over a reduced length equal to a few mm.

Figure 4:
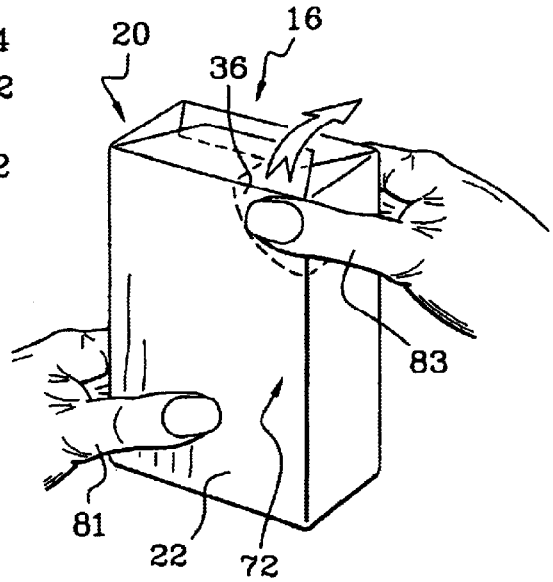
FIGS. 4 to 6 are diagrammatic perspective views illustrating the successive steps of releasing the gripping zone of a bundle of paper handkerchiefs similar to that illustrated in FIG. 3.

At the time of first use, according to FIG. 4, the user holds the bundle 16, for example in his left hand 81 if he is right-handed, in a vertical position, the front face 22 facing him. He then presses on the flap 36 with a finger which may be the thumb 83 of his right hand, so as to cut the portions of the wrapping 20 which are located between the orifices of the precut 72. The flap 36 is thus made movable.

Figure 5:
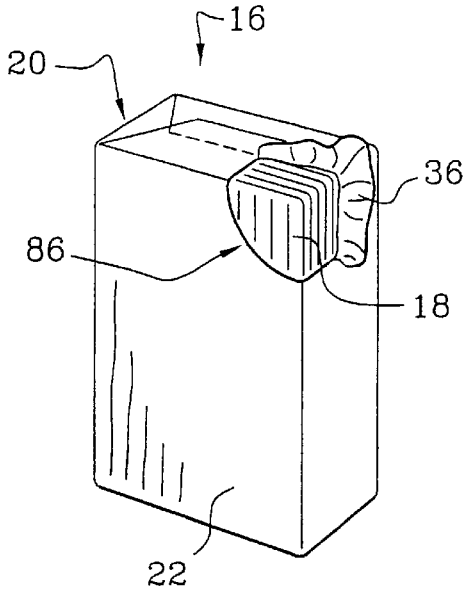

In order to extract a folded handkerchief 18 from the bundle 16, the user must continue the pressing movement which he exerts with his thumb, so as to place the movable flap 36 in the opening position, making it possible to release a gripping zone 86, according to FIG. 5, which is located in the upper corner. He can then easily grasp a corner of a handkerchief 18 and extract it from the wrapping 20. The gesture of extracting a handkerchief 18 from the bundle 16 according to the invention is therefore easy and natural for the user.

Advantageously, the opening of the bundle 16 of handkerchiefs 18 may be carried out with only one hand. For example, the thumb and the second finger hold the bundle 16, and the index finger releases the gripping zone 86, or else the thumb releases the gripping zone 86, the bundle 16 of handkerchiefs 18 being wedged by the palm of the hand, and the other fingers being bent round the bundle 16.

Extraction of the handkerchief 18 is carried out substantially along a diagonal of the fore front face 22 of the bundle 16, and it is made easier because the frictional forces are distributed to the two sides of the handkerchief 18 which are adjacent to the gripping zone 86.

When the handkerchief 18 has been extracted from the wrapping 20, the gripping zone 86 is covered by the movable flap 36.

Figure 6:
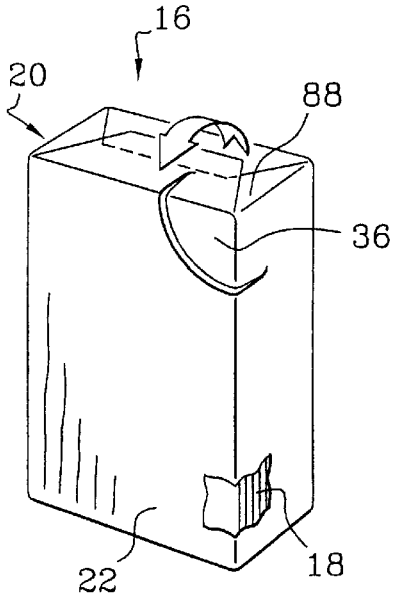
Figure 7:
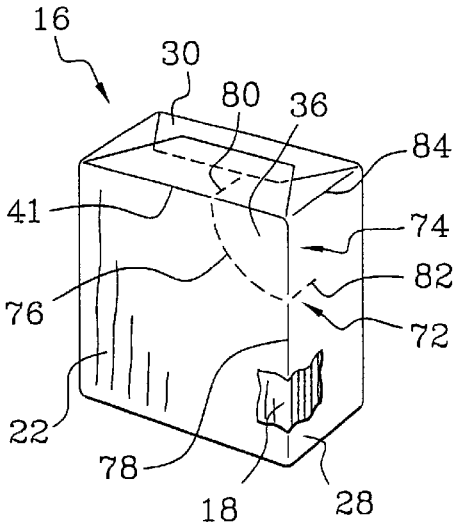
FIG. 7 is a diagrammatic perspective view of another example of a bundle of paper products which is produced according to the invention and has square front faces.

The movable flap 36 can also return automatically to the closing position according to FIG. 6.

The return movement of the movable flap 36 towards its closing position occurs, in particular, as a result of the elasticity of a part of the wrapping 20 located in a zone 88 which is between the two free ends of the second and third portion 80 and 82 respectively and which tends to return the movable flap 36 automatically into the closing position.

Such a bundle 16 of handkerchiefs 18 makes it possible to eliminate the retaining means 42, thus reducing the manufacturing costs. The wrapping 20 of the bundle 16 now consists only of a single material.

Furthermore, the movable flap 36 makes it possible to reclose the bundle 16 more hermetically than according to the prior art. To be precise, the aperture is narrower and the movable flap 36 is held in the closing position as a result of the elastic effect of the zone 88. The folded handkerchiefs 18 are then better protected and are soiled to a lesser extent.

Since the movable flap 36 is formed in a corner of the bundle 16, it makes it possible, after first use, to reduce the decrease in rigidity of the bundle 16 attributable to its cut.

Advantageously, the height H and the width L of the bundle 16 are equal, so that the fore 22 and rear 24 front faces are square.

However, the dimensions of the height H and of the width L of the bundle 16 of handkerchiefs 18 may have a tolerance of 4 millimeters more or less for a typical deviation of the order of 2 mm.

This tolerance also applies to the height dimension in relation to the width dimension.

Consequently, what are meant by an equal height and width are a height and width which may not be strictly equal and may have some variation in relation to one another.

Preferably, the width L of the bundle 16 of handkerchiefs 18 according to the invention is equal to the width L of the bundle 16 according to the prior art, that is to say to a value of between 50 and 58 mm. Thus, the height H of the bundle 16 according to the invention is smaller than the height H of the bundles 16 produced according to the prior art.

The dimensions of the bundle 16 according to the invention are reduced in relation to the known types of bundles 16 of handkerchiefs 18.

The extraction of the folded handkerchiefs 18 from the bundle 16 is made easier because their symmetrical square shape allows a homogeneous and balanced distribution of the frictional forces between the extracted folded handkerchief 18 and the interior of the wrapping 20.

Since the fore 22 and rear 24 front faces are square, the manufacture of the bundle 16 is made easier, since the precut 72 can be made, regardless, in one of the eight corners of one of the front faces 22 and 24.

The packaging process is also simplified, since it is not necessary to orient the sides of the folded handkerchiefs 18 with respect to the width L or to the height H of the bundle 16.

The use of the bundle 16 of handkerchiefs 18 is simplified for the same reasons. To be precise, whatever the corner in the vicinity of which the movable flap 36 is produced, a rotation of the bundle 16 about one or more axes perpendicular to its faces makes it possible to place the movable flap 36 in the position most favourable to the user. That is to say, for example, in the right upper corner for a right-handed person. There is no longer any notion of height or width. The extraction of a folded handkerchief 18 is therefore a gesture which is even easier and more natural for the user.

As regards this embodiment, it is even easier to open the bundle 16 with only one hand, thus making it easier to use it.

Moreover, the bundle 16 according to the invention is discrete and makes it possible to reduce the bulk of, for example, the pockets and handbags in which it may be carried.

It also limits the risk of damage to the garments, in particular the pockets, into which it is slipped.

The parallelepipedic format, with square front faces 22 and 24, of the bundle 16 makes it possible to increase its rigidity. Thus, it is more rigid and preserves its shape when it is subjected to forces, in particular when it is in a trouser pocket or in a handbag.

Figure 8:
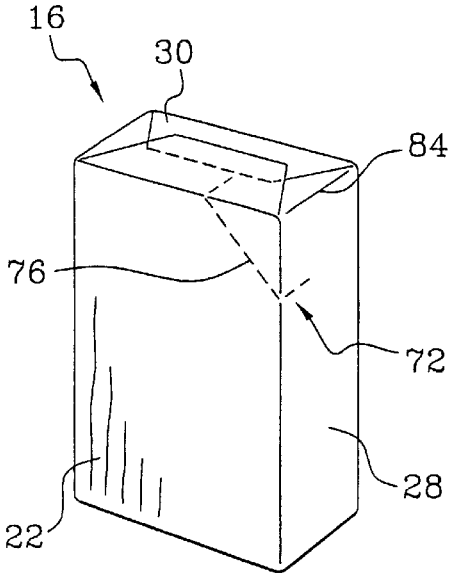
FIG. 8 is a view similar to that illustrated in FIG. 3, that portion of the precut located on the rectangular fore front face being a straight-line segment.

The first portion 76 may have a different shape, such as a straight-line segment, according to FIG. 8, which may be perpendicular to a plane passing through the edge common to the second and third faces and passing through the bisector of the angle formed by the other two edges.

Figure 9:
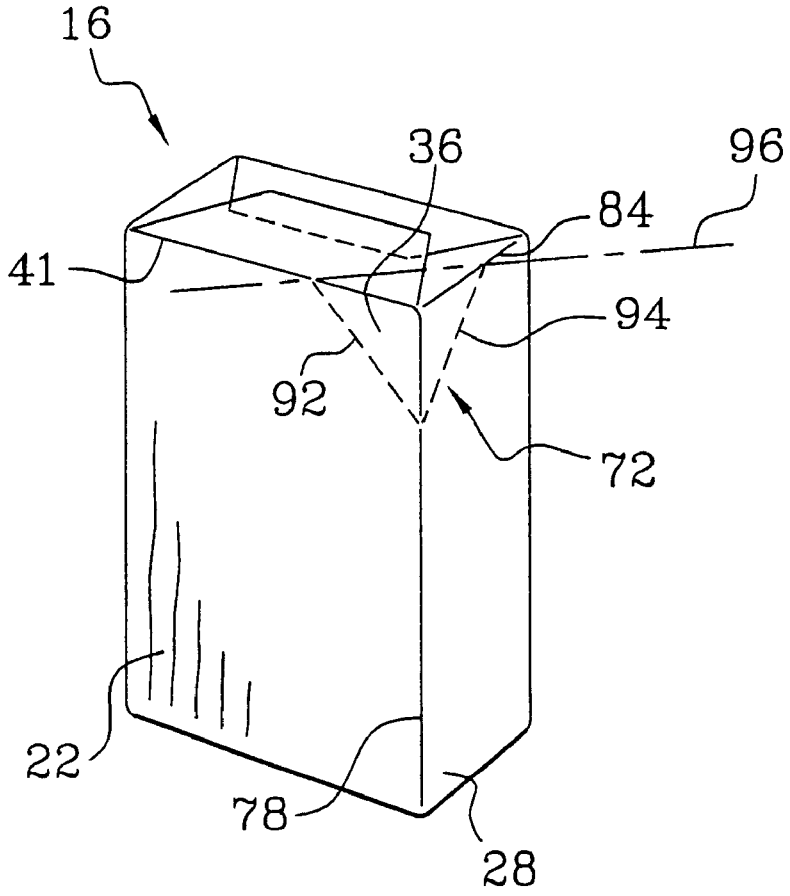
FIG. 9 is a diagrammatic perspective view of a bundle of handkerchiefs comprising opening means produced according to a variant of the invention.

According to a variant of the invention, the precut 72 may comprise two portions 92, 94 which are connected to one another and which each extend over a separate face 22, 28 of the bundle 16, according to FIG. 9.

The two portions 92 and 94 have two straight-line segments which, here, are formed on the fore front face 22 between the edges 41 and 78 and on the right lateral face 28 between the edges 78 and 84 respectively, in the vicinity of the right upper fore corner 74 of the bundle 16. Thus, when it is being opened, the movable flap 36 pivots about an axis 96 located in the upper lateral face 30 and passing through the point of concurrence of the precut 72 and of the edges 41 and 84.

Advantageously, the triangles defined by the precut 72 and the edges 41, 78 and 84 of the bundle 16 are equilateral. The gripping zone 86 then has the shape of an equilateral pyramid, that is to say its four faces are equal. Thus, the gripping zone 86 releases a pyramidal zone of the stack of handkerchiefs 18.

The two portions 92 and 94 may also be two arcs of a circle, the dimensions of which are, for example, close to those of the end of the user's thumb.

According to these last two variants, the movable flap 36 is not retained in the closing position, and it is then advantageous to fasten to it retaining means 42, such as an adhesive tape or adhesive patch.

To make it possible for the movable flap 36 to return to and be kept in the closing position, it is advantageous if the portions 92 and 94 originating from the edge 78 are not prolonged as far as the edges 41 and 84 respectively of the upper lateral face 30 of the bundle 16 of handkerchiefs 18.

What is claimed is:

1. Bundle (16) of stacked products (18) of absorbent paper, which comprises a flexible wrapping sheet (20), which is of parallelepipedic general shape defined by a height (H), a width (L) and a thickness (E), and which comprises an opening region making it possible to release a zone (86) for gripping at least one paper product (18) in order to extract it individually from the wrapping sheet (20), the opening region comprising a flap (36) which is movable between an opening position, making it possible to release the zone (86) for gripping at least one folded paper product (18), and a closing position, covering the gripping zone (86), and which is a part of the wrapping sheet (20), delimited by a precut (72) or a cut of the wrapping sheet (20), wherein the precut (72) or cut is arranged in a corner (74) of the bundle (16), is continuous, extends between a first free extremity and a second free extremity, and consists of three consecutive portions (76, 80, 82) which are connected to one another and which each extend over a separate face (22, 28) of the bundle (16), wherein a first intermediate portion (76) of said three portions extends over a first face between two concurrent edges (41, 78), and wherein second (80) and third (82) end portions of said three portions extend over a second and a third face, respectively, starting from each of the ends of the first intermediate portion (76), each second and third end portion (80, 82) being a straight-line segment parallel to the edge (84) which corresponds to the intersection of the second and third faces, and each second and third end portion (80, 82) including a free end, and wherein the first free extremity of the precut is the free end of the second end portion and the second free extremity of the precut is the free end of the third end portion.

2. Bundle (16) of paper products (18) according to claim 1, characterized in that a first of said three portions (76) is an arc of a circle, having a center which corresponds substantially to a point of concurrence of three edges which delimit the corner of the bundle (16).

3. Bundle (16) of paper products (18) according to claim 1, characterized in that the first of said three portions (76) comprises at least one straight-line segment.

4. Bundle (16) of paper products (18) according to claim 1, characterized in that the precut (22) or the cut is substantially symmetrical with respect to a plane passing through an edge common to the second and third faces and through the bisector of an angle formed by the other two edges (41, 78).

5. Bundle (16) of paper products (18) according to claim 1, characterized in that the first of said three portions (76) is a straight-line segment perpendicular to a plane passing through an edge common to the second and third faces, and through the bisector of an angle formed by the other two edges (41, 78).

6. Bundle (16) of paper products (18) according to claim 1, characterized in that the first face is one of the front faces (22, 24).

7. Bundle (16) of paper products (18) according to claim 1, characterized in that at least one of the paper products (18) is a handkerchief.

8. Bundle (16) of paper products (18) according to claim 1, characterized in that at least one of the paper products (18) is a napkin.

9. Bundle (16) of paper products (18) according to claim 1, characterized in that the height (H) and the width (L) are equal, in such a way that the bundle (16) comprises square fore (22) and rear (24) front faces.

10. Bundle (16) of paper products (18) according to claim 1, characterized in that each paper product (18) is folded so as to form a square, of which the number of layers of absorbent paper is a multiple of four.

11. Bundle (16) of paper products (18) according to claim 10, characterized in that its height and its width are between 50 and 58 millimetres.

12. Bundle (16) of paper products (18) according to claim 1, characterized in that each folded paper product (18) comprises sixteen layers of absorbent paper.

* * * * *